US007269500B2

(12) United States Patent
Cochet et al.

(10) Patent No.: US 7,269,500 B2
(45) Date of Patent: Sep. 11, 2007

(54) PROCESS FOR DETERMINING THE OPERATING PARAMETERS OF AN INJECTION DEVICE

(75) Inventors: Thierry Cochet, Molineuf (FR); Guillaume Meissonnier, Landes le Gaulois (FR)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/389,375

(22) Filed: Mar. 24, 2006

(65) Prior Publication Data

US 2006/0224299 A1 Oct. 5, 2006

(30) Foreign Application Priority Data

Mar. 25, 2005 (EP) ..... 05290675

(51) Int. Cl.
*G06F 19/00* (2006.01)
*G01M 15/00* (2006.01)

(52) U.S. Cl. ..... 701/114; 73/119 A; 73/116; 701/115

(58) Field of Classification Search ..... 701/101, 701/105, 114, 115; 73/116, 119 A
See application file for complete search history.

(56) References Cited

U.S. PATENT DOCUMENTS 4,665,703 A * 5/1987 David ..... 60/595
5,515,281 A * 5/1996 Palazzetti et al. ..... 701/111
6,874,480 B1 * 4/2005 Ismailov ..... 123/494

FOREIGN PATENT DOCUMENTS

EP 1350941 10/2003
EP 1388661 2/2004
FR 2720787 12/1995

* cited by examiner

*Primary Examiner*—John T. Kwon
(74) *Attorney, Agent, or Firm*—David P. Wood

(57) ABSTRACT

A process for determining the operating parameters of an injection device of a combustion engine includes the steps of: (a) selecting an injector to test; (b) calculating a mean velocity associated with a preceding injector arranged before the injector to test; c) applying to the injector to test an injection control signal including at least one test pulse having an adjustable parameter; (d) calculating a mean velocity associated with the injector to test; (e) calculating a difference between the mean velocity calculated in step d) and the mean velocity calculated in step b); (f) repeating steps b) to d) for at least another engine cycle, each time varying the parameter of the test pulse; (g) determining a value of the parameter of the test pulse for which the mean velocity difference exceeds a predetermined threshold; and storing the parameter value.

21 Claims, 6 Drawing Sheets

PROCESS FOR DETERMINING THE OPERATING PARAMETERS OF AN INJECTION DEVICE

TECHNICAL FIELD

The present invention has as its object a process for determining the operating parameters, also called a learning process, of an injection device of a combustion engine.

BACKGROUND OF THE INVENTION

Conventionally, an injection device includes a plurality of injectors, each of the injectors being controlled to open and close by an electronic control means, by means of control signals permitting driving of one or more pilot injections and a main injection at each of the injectors. The injectors used may be of several types, for example of solenoid type or piezoelectric type.

The document EP 0 740 068 describes a solenoid injector. The injector includes an injector body. At its lower end, the injector body defines a seat in which the lower end of a needle is able to engage, the needle being able to slide between an open position in which it permits ejection of fuel from the injector and a closed position in which it sealedly closes the injector. The injector body is supplied with fuel by a high-pressure fuel source, such as a common rail, using a supply passage emerging in an annular gallery. The annular gallery surrounds the needle, in the proximity of its upper end, the form of the needle being suitable to allow circulation of fuel from the annular gallery between the bore and the needle. The high pressure supply line also communicates with a control chamber through a "restrictor". At its upper end, the control chamber is closed by a plate. The plate co-operates with a sliding valve member including a hollow rod, the inside of the hollow rod being able to communicate with the inside of the chamber when the valve member is disengaged from the plate. The inside of the hollow rod also communicates with a low-pressure return. An electronic control means controls, by means of control signals, a solenoid actuator. When the solenoid is supplied, the valve member is disengaged from the plate. At this moment, fuel in the control chamber can escape to the inside of the hollow rod and then into the low-pressure return. When the pressure inside the control chamber drops to a certain point, the force applied to the needle due to the pressure inside the control chamber is no longer sufficient to keep the needle in its closed position. At this moment, the needle adopts its open position and fuel is ejected from the injector. When the solenoid is no longer supplied, the valve member is re-engaged in the plate under the influence of a spring. This has the effect of closing communication between the inside of the hollow rod and the control chamber. At this moment, the pressure in the control chamber increases and pushes the needle into its closed position.

The document EP 0 937 891 describes a piezoelectric injector. The injector includes a piston which defines a control chamber in combination with the upper surface of the needle. The injector includes piezoelectric actuators. The actuators are electrically connected to a control circuit able to emit control signals. The pressurised fuel present in the control chamber applies a force to the upper part of the needle and allows it to be held in the closed position, in combination with a spring. To start the injection, the piezoelectric material is discharged, in order to reduce its size. The effect of this is a movement of the piston in the direction opposite to the needle and therefore a reduction in the pressure inside the control chamber. At this moment, the needle is in its open position. When the piezoelectric material is charged, this has the effect of pushing the piston downwardly. This movement increases the fuel pressure inside the control chamber, thus increasing the force applied to the upper surface of the needle, which has the effect of pushing it back into its closed position.

Even if the injectors used in the injection device are of the same type, each injector has specific parameters. In addition, mechanical wear can also affect the accuracy of the quantity of fuel injected. Learning processes must therefore be performed to adapt the control signals to the specific characteristics of each of the injectors, in order to balance the operation of the engine to the maximum extent, to optimise combustion noise and control gas emissions. In particular, these processes permit determination for each injector of the minimum drive pulse (MDP) causing opening of the injector.

A first solution consists of using an accelerometer. However, this solution is sensitive to vibrations and this causes accuracy problems, particularly with piezoelectric injectors.

A second solution consists of using a velocity sensor permitting continuous determination of the crankshaft velocity.

The document FR 2 720 787 describes a process for determination of the specific parameters of each of the injectors of an injection device of a combustion engine, in particular of a device with pilot injection and main injection. For this purpose, the curve is determined of the difference in instantaneous velocity of the drive shaft between the instant of passage through combustion top dead centre of the cylinder in question and a subsequent predetermined instant, for example offset by 60°, prior to passage through combustion top dead centre of the following cylinder, as a function of the duration of pilot injection, the other operating parameters being kept constant. This curve presents a minimum plateau. The gradient break point of this curve permits determination of the opening time of the injector from which the injector starts to deliver. This process is intended to be implemented for example at the end of assembly line check to tune the engine or to perform tests in case of malfunction of the engine within the context of after-sales service.

The process described in this document cannot be performed when the engine is outside the idling zone, i.e. when the injectors are being controlled by control signals corresponding to a demand of a gas control organ. This process, which was designed for use during engine idling uses an instantaneous velocity difference which is very sensitive to the shape of the instantaneous velocity curve of the engine at each injection cycle. The present inventors have found that this shape lost its uniformity at high revolutions, so that the difference in question depended as much on the rotational velocity of the engine as on the quantity injected. This resulted in the impossibility of using this process quantitatively other than during idling. Moreover, the difference in instantaneous velocity which is used in this process [is] very dependent on the engine velocity, and this results in a large margin of error if the engine velocity is not constant over the whole learning period.

SUMMARY OF THE INVENTION

The present invention has the aim of proposing a process for determining the operating parameters of an injection device of a combustion engine which avoids at least certain of the above-mentioned disadvantages and which is more accurate. A further aim of the invention is to propose a learning process which can be used at different engine velocities and/or at different injector supply pressures in order to determine the relevant parameters over an extended operating range.

To this end, the invention has as its object a process for determining the operating parameters of an injection device of a combustion engine, the injection device including a plurality of fuel injectors, and an electronic control means able to control the injectors by means of injection control signals, the electronic control means being connected to a sensor permitting continuous measurement of a velocity of the combustion engine, the engine operating in accordance with an engine cycle including at least one injection cycle associated with each of the injectors, the injection cycles following each other in a predetermined order, characterised by the fact that it comprises the steps consisting of:

a) selecting an injector to test from the injectors;

b) calculating a mean velocity associated with a preceding injector arranged before the injector to test in the order of the injection cycles, which is equal to the velocity of the engine averaged over a measurement duration essentially covering one injection cycle associated with the preceding injector;

c) for the injection cycle associated with the injector to test, applying to the injector to test an injection control signal including at least one test pulse having an adjustable parameter;

d) calculating a mean velocity associated with the injector to test, which is equal to the velocity of the engine averaged over a measurement duration essentially covering the injection cycle associated with the injector to test;

e) calculating a difference between the mean velocity calculated in step d) and the mean velocity calculated in step b);

f) repeating steps b) to d) for at least another engine cycle, each time varying the parameter of the test pulse;

g) determining a value of the parameter of the test pulse for which the mean velocity difference exceeds a predetermined threshold and storing the parameter value.

In accordance with one embodiment of the invention, the injectors have direct actuation. These injectors allow a more accurate result to be obtained, due to the absence of hydraulic interaction.

Advantageously, in step c), the control signal includes a plurality of test pulses, the value of the parameter being the same for each of the test pulses.

In accordance with one characteristic of the invention, the parameter is a pulse duration.

In accordance with a particular embodiment, while the process is being performed, the injection control signals of the injectors other than the injector to be tested are nil. This corresponds for example to execution of the process when the accelerator pedal is raised.

In accordance with another embodiment, while the process is being performed, the electronic control means provides to the injectors injection control signals including a main pulse corresponding to a demand emanating from a gas control organ. This corresponds for example to execution of the process when the accelerator pedal is depressed.

Advantageously, before step g), a filtered mean velocity difference is calculated by applying a convolution by a filter to the curve representing the mean velocity difference as a function of the test pulse parameter, and the filtered mean velocity difference is used in step g). Preferably, the filter is a sliding mean.

In accordance with one characteristic of the invention, the process includes a first step consisting of testing a predetermined stability condition to detect stable operation of the engine, and a step consisting of terminating the process when the stability condition is not satisfied. Verification of the stability condition is not essential to performance of the learning process, but it simplifies data processing. The stability condition is composed of one or more elementary conditions, which my be cumulative or alternative. In particular, provision may be made for the stability condition to be verified when a plurality of elementary conditions is verified. The elementary conditions can be tested simultaneously or in succession. A non-limiting list of elementary conditions which can allow detection of a so-called stable zone is given below.

Advantageously, the stability condition includes an engine velocity condition, which condition is verified when the engine velocity is between two predetermined thresholds (minimum and maximum).

Advantageously, the stability condition includes an engine torque condition, which condition is verified when the engine torque is between two predetermined thresholds (minimum and maximum).

Advantageously, the stability condition includes a gear ratio condition, which condition is verified when the gear ratio is greater than a predetermined threshold.

Advantageously, the stability condition includes a condition of the speed of the vehicle, which condition is verified when the vehicle speed is higher than a predetermined threshold.

Advantageously, the stability condition includes a clutch engagement condition, which condition is verified when clutch engagement is activated.

In accordance with one characteristic of the invention, at each engine cycle the process includes a step consisting of calculating a difference between the mean velocity calculated in step b) for the engine cycle and the mean velocity calculated in step b) for a preceding engine cycle, a step consisting of calculating a corrected mean velocity difference by correcting the mean velocity difference calculated in step e).

In accordance with one characteristic of the invention, the velocity of the combustion engine corresponds to the rotational velocity of a crankshaft of the combustion engine, the measurement period associated with an injector extending each time between an initial instant retarded by an offset angle $\alpha$ of the crankshaft relative to combustion top dead centre of a piston corresponding to the injector and a final instant retarded by the offset angle $\alpha$ relative to top dead centre of the piston corresponding to the next injector in the order of the injection cycles. Advantageously, the offset angle $\alpha$ is less than or equal to 45°.

Preferably, the injection device includes a common rail provided with a high pressure valve, each of the injectors being connected to the common rail. The presence of a high pressure valve in the common rail is preferable but not essential.

In accordance with one characteristic of the invention, the process includes a step consisting of selecting a common rail pressure within a range of for example 200 to 2000 bars and performing the process while this common rail pressure is maintained in the common rail.

Advantageously, the process includes the steps consisting of detecting actuation of an organ for controlling the gases of the vehicle corresponding to a fuel demand, calculating a common rail target pressure suited to the fuel demand and, when the target pressure is lower than the selected common rail pressure, reducing the pressure in the common rail by opening the high pressure valve.

Preferably, the process includes the steps consisting of detecting actuation of an organ for controlling the gases of the vehicle corresponding to a fuel demand, calculating a common rail target pressure suited to the fuel demand and, when the target pressure is less than the selected common rail pressure, providing injection control signals to the injectors including at least one pre-injection pulse and one main pulse.

BRIEF DESCRIPTION OF THE DRAWINGS

The invention will be better understood and other aims, details, characteristics and advantages of it will become more clearly apparent in the course of the following detailed explanatory description of several embodiments of the invention given as purely illustrative and non-limiting examples, with reference to the attached diagrammatic drawings. In these drawings.

DESCRIPTION OF THE PREFERRED EMBODIMENT

Figure 1:
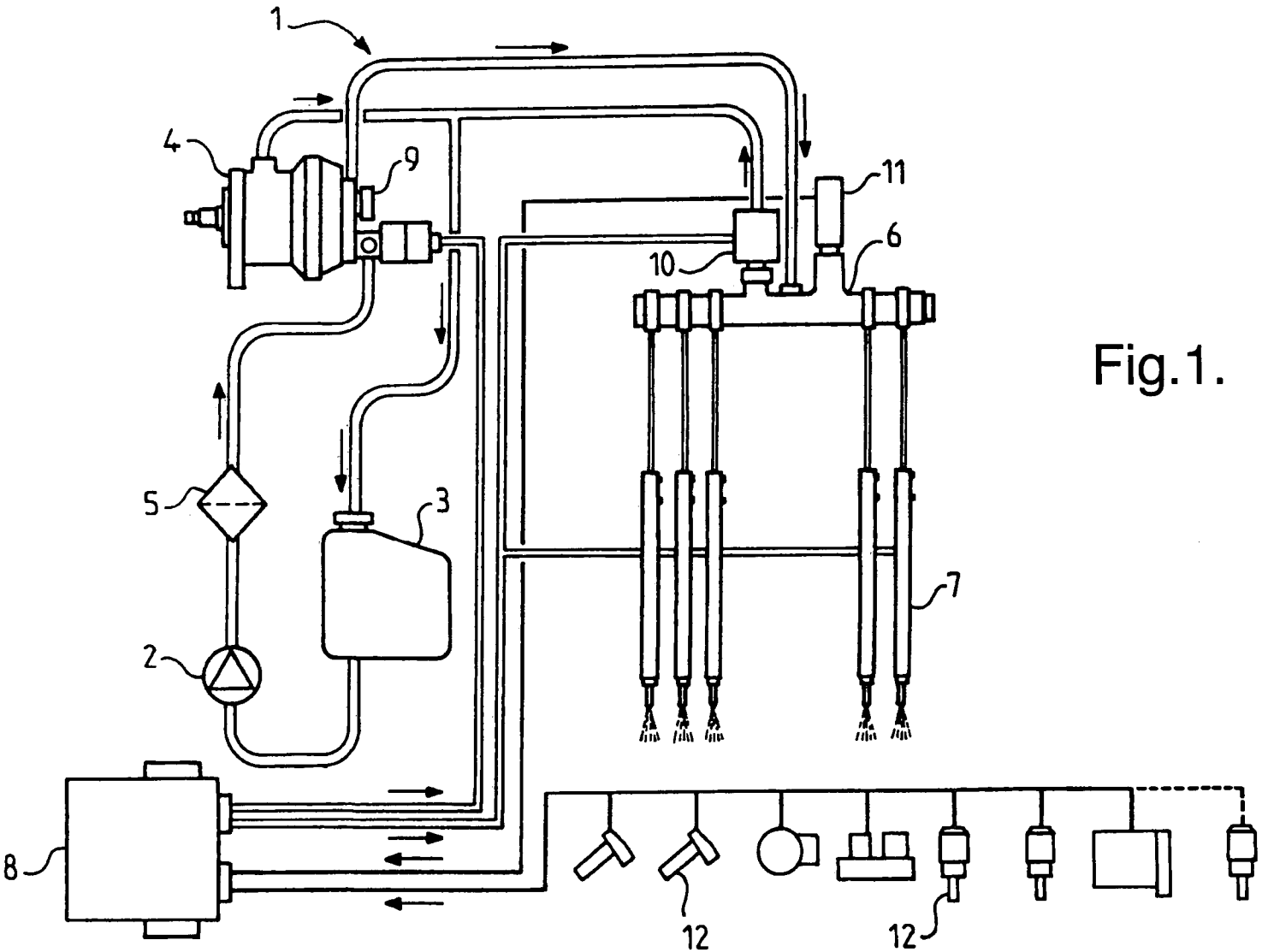
FIG. 1 is a diagrammatic view showing a fuel supply system including the injection device in accordance with one embodiment of the invention.

With reference to FIG. 1, this shows a fuel supply system 1 for an internal combustion engine. The supply system 1 is arranged in a vehicle (not shown) and co-operates with an engine (not shown), the injectors 7 injecting fuel into cylinders (not shown) of the engine, for example diesel. The supply system 1 includes a low pressure pump 2, also called the lift pump, the delivery pressure of which is for example approximately equal to 6 bars. The pump 2 is so arranged as to be able to remove fuel from a fuel tank 3 and supply fuel to an intake of a high pressure pump 4 via a filter 5. The delivery pressure of the pump 4 is adjustable within a range of the order of 200-1800 bars or higher. The high pressure pump 4 is arranged to load a common rail 6 with fuel at high pressure. Injectors 7 are connected to the common rail 6, each of the injectors 7 being controlled to open and close by an electronic control unit 8, currently called the drive computer, by means of control signals. The control unit 8 also controls the high pressure pump 4 by controlling a filling actuator 9, and the fuel pressure in the common rail 6 by means of a high pressure valve 10. A pressure sensor 11 permits measurement of the pressure in the common rail 6 and its communication to the control unit 8. The control unit 8 receives signals relating to the engine parameters, such as the speed of the vehicle or the position of the accelerator pedal, through appropriate sensors 12. Among the sensors 12, a crankshaft sensor permits measurement, for example magnetically, of the rotational velocity of a crankshaft of the engine. The rotational velocity of the crankshaft will from now on be considered as the engine velocity. The set of sensors also includes a sensor for detection of top dead centre (TDC), which allows synchronisation of injection with the movement of the pistons, and a sensor for detecting the position of the accelerator pedal.

Figure 2:
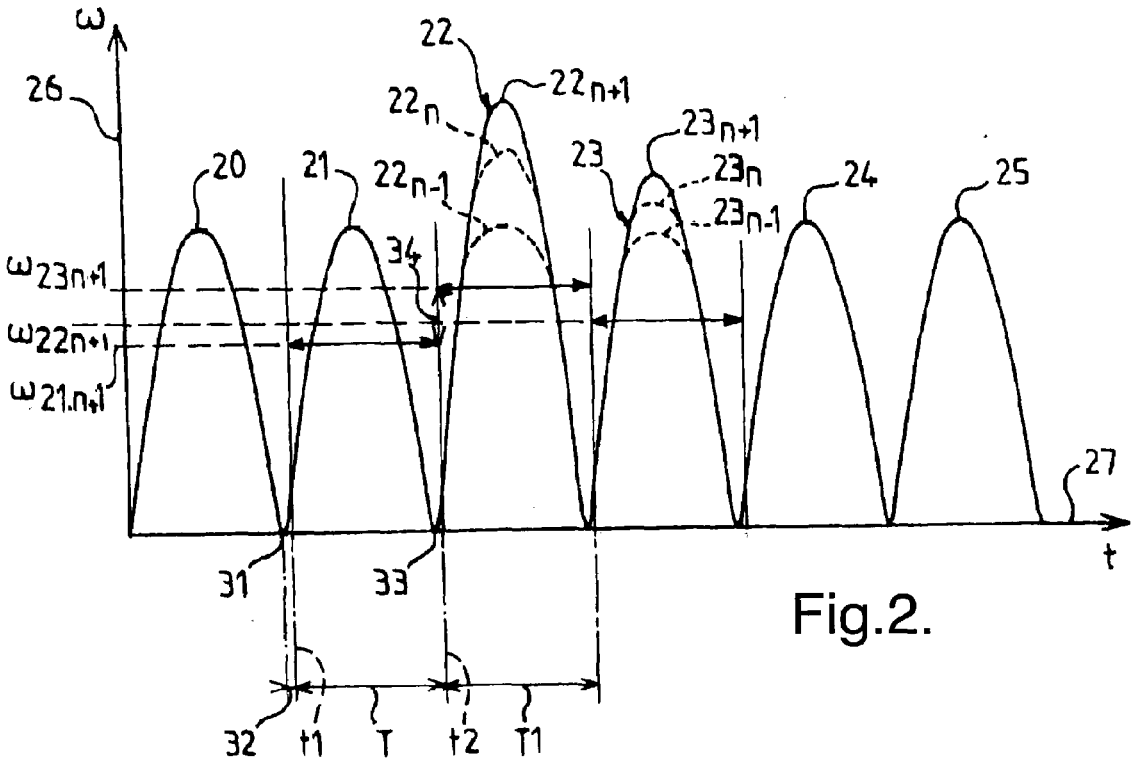
FIG. 2 is a curve showing the evolution of the instantaneous velocity of the engine as a function of time during one engine cycle.

FIG. 2 shows the evolution of the instantaneous velocity of the engine ω, axis 26, as a function of time t, axis 27, over an engine cycle of a six-cylinder engine. The origin of the axis 26 does not correspond to 0. For a four-stroke engine, one engine cycle corresponds to rotation of the crankshaft by 720°. Each injector 7 is associated with a cylinder including a piston (not shown). In an engine cycle, the injectors of the engine are activated in succession in a predetermined order, which corresponds to the order in which the pistons reach their respective top dead centres, so as to produce balanced driving of the crankshaft. For example, for a four cylinder engine, the activation sequence is generally: first cylinder, third cylinder, fourth cylinder, second cylinder. The velocity curve in arches is classic and arises from the fact that each piston tends to slow down as it compresses the gases in the cylinder and arrives at its top dead centre and to re-accelerate under the thrust of the gases as it leaves its top dead centre. Thus, in FIG. 2, the engine cycle includes six arches corresponding to six injection cycles 20, 21, 22, 23, 24 and 25, each cycle 20 to 25 being associated with an injector 7. In the following, these reference numbers designate either the arch itself, or the corresponding time interval. Each injection cycle 20 to 25 is between the top dead centres (TDC) of two pistons. In what follows, the order of the injectors 7 refers to the order of the associated injection cycles 20 to 25, which can therefore be distinct from the geometrical order of the engine cylinders. For example, a first injector 7 will be considered as preceding a second injector 7 if the injection cycle associated with the first injector is performed before the injection cycle associated with the second injector, for a given engine cycle.

In normal operation, the drive computer 8 receives the control signal from the accelerator pedal and calculates the fuel flows having to be injected into each cylinder as a function of this signal (algorithm itself known). The computer 8 produces injector control signals to inject the calculated flows, each time in the form of one or more pulses, for example a pilot pulse and a main pulse. These flows correspond to the quantity of fuel necessary to operation of the engine. The computer 8 calculates and adjusts the common rail pressure as a function of the fuel demand (algorithm itself known). The calculated pressure is called the common rail target pressure. For example, at 4500 rpm the pressure in the rail 6 is approximately equal to 1800 bars. The computer 8 also controls idling, which corresponds to a predetermined minimum velocity which the computer 8 maintains when no signal is transmitted by the accelerator pedal. These functionalities obtained by programming the drive computer 8 are conventional and will not be described in detail.

The computer 8 contains a learning program execution of which controls the progress of a process which will now be described.

Performance of the Process

Figure 3:
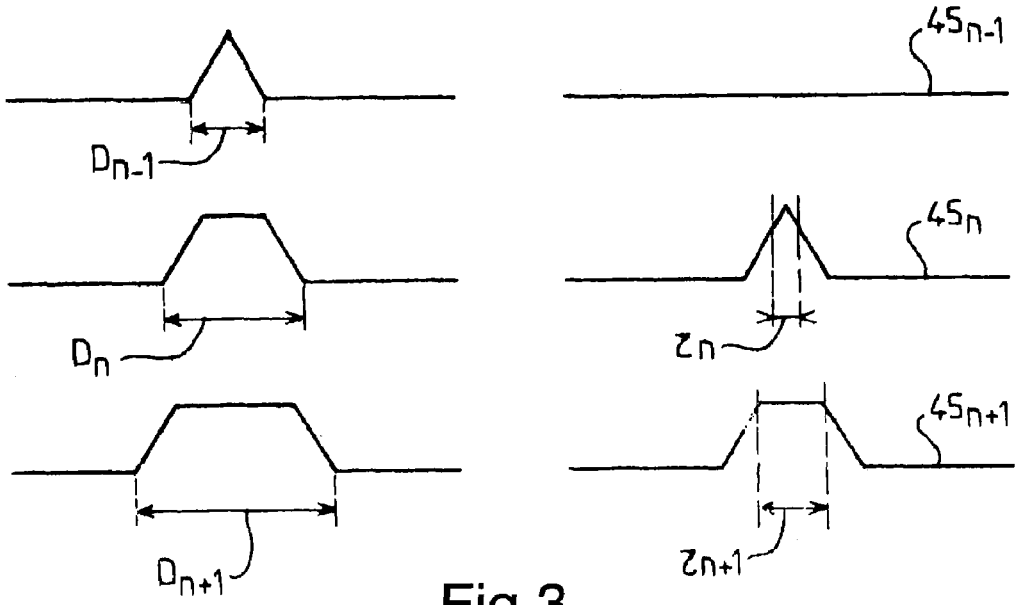
FIG. 3 is a diagrammatic view showing curves of control signals and the response of an injector to these signals.
Figure 4:
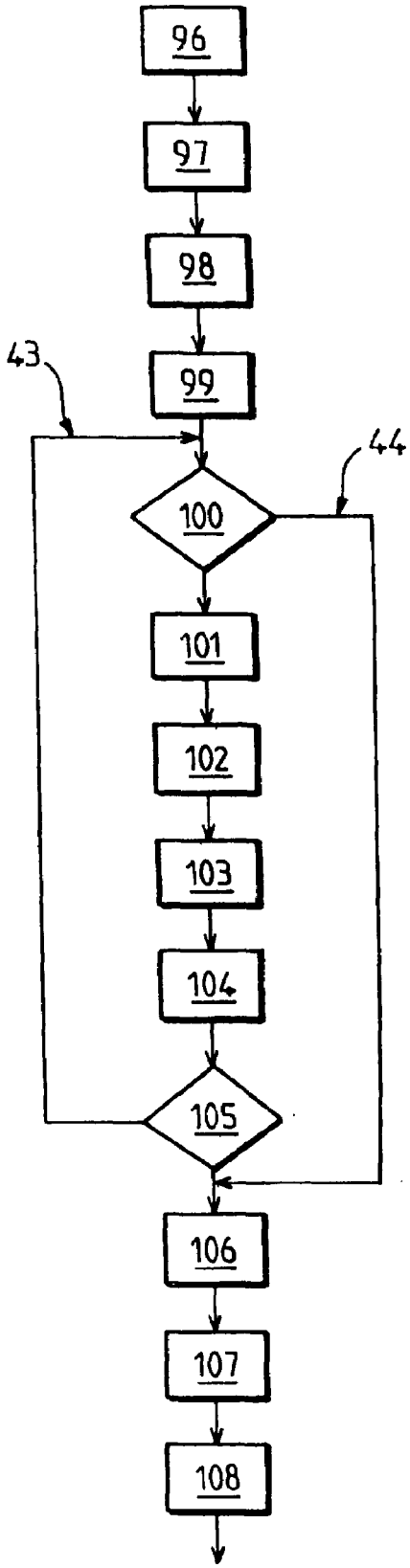
FIG. 4 is a block diagram showing the steps of the learning process, in accordance with a first embodiment of the invention.

With reference to FIGS. 2 to 4, the progress of the learning process to determine the value of a parameter of the control signal associated with an injector 7 will now be described. This process is performed while the engine is turning. The parameter which is required to be determined is, in the present case, a minimum drive pulse (MDP) of the control signal which causes effective opening of an injector 7.

In step 96, the process is initialised. This type of learning is intended to be effected during the use of the vehicle, for example initialisation takes place every quarter of an hour or every hour. By performing this process regularly, statistical processing can be carried out on the minimum duration values obtained at each execution, which allows more accurate values to be obtained.

In step 97, the rail pressure is set.

In step 98, the injector under test, i.e. the injector for which it is required to determine the minimum drive pulse, is selected. In FIG. 2, which will be used to describe an example of performance of the process, this is the injector associated with the injection cycle 22.

In step 99, an initial drive pulse D0 is set. The initial drive pulse D0 corresponds to the duration of a test pulse which will be sent to the selected injector to perform injection cycle 22, for example in the vicinity of top dead centre 33 of the engine cycle, during the first passage through loop 43 of the process. A drive pulse D is then incremented on each passage through loop 43, a test pulse of a duration equal to the current drive pulse in loop 43 being sent to the injector selected to perform injection cycle 22, for example in the vicinity of TDC 33, at each engine cycle during the process. The expression each engine cycle in fact designates the cycles during which the loop 43 is executed. Two successive passages through loop 43 can optionally be spaced apart one from the other.

Steps 100 to 106 will now be described, on a passage through loop 43. The number of passages through the loop 43 is indexed by an index in the following description. For illustration, three successive passages are referred to below, of rank n−1, n and n+1.

Figure 5:
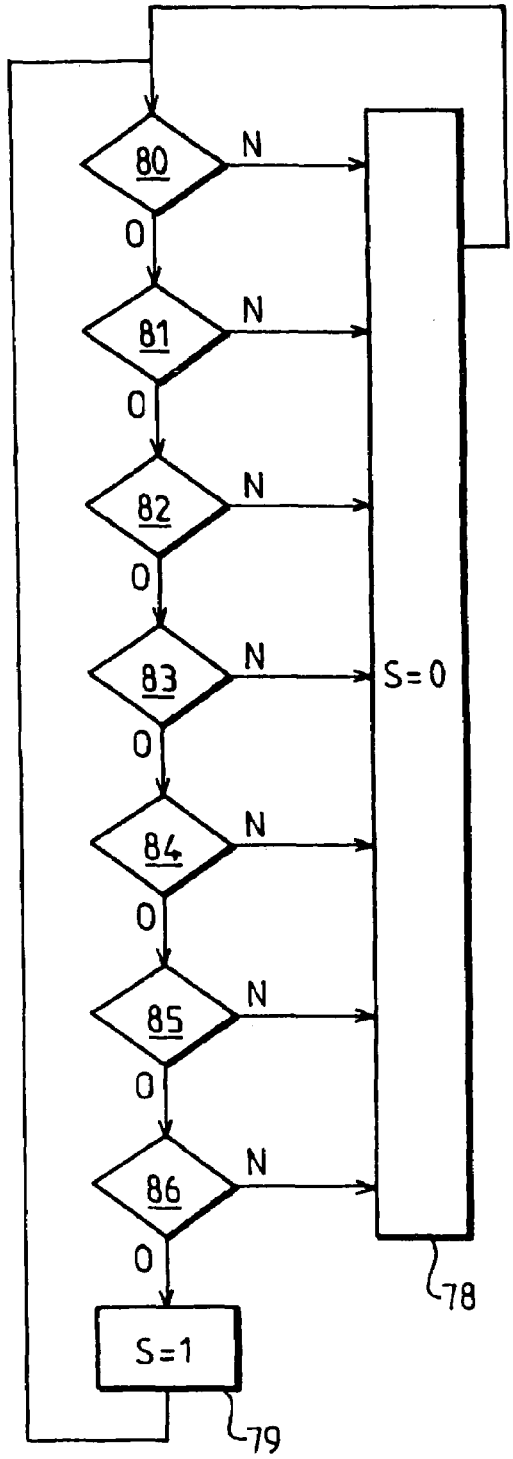
FIG. 5 is a block diagram showing the steps of determination of a stable zone.

In step 100, a stability condition, which will be described in detail below with reference to FIG. 5, is tested. In the first embodiment described below, this condition is so defined as to ensure that the engine operates in a phase in which no fuel injection is required and in which the control signals of all the injectors are therefore uniformly nil, apart from the signals specifically generated for the needs of the learning process. This is why the arches 20, 21, 24 and 25 are not considered as evolving significantly from one engine cycle to the other. If the stability condition is verified, the process passes to step 101, otherwise the process is interrupted or, at least, loop 43 is quitted (arrow 44), which corresponds to passage to step 106. This second possibility permits use of measurements acquired during preceding passages through loop 43, where necessary.

Step 101 consists of calculating a mean velocity $\omega_{21,n-1}$ (FIG. 2) of the engine over the injection cycle 21, which immediately precedes cycle 22. The mean velocity $\omega_{21,n-1}$ is calculated over a measurement duration T which essentially covers injection cycle 21, by an integral calculated between the instants t1 and t2:

$$\omega_{21,n-1}=1/T.\int \quad (1)$$

The initial instant t1 of the measurement period T is for example offset relative to top dead centre 31 by a period 32 which corresponds to an angle of offset α of rotation of the crankshaft. In this case, the final instant t2 of the measurement period T is offset by the same angle α relative to top dead centre 33 associated with the next injector.

The step 102 consists of calculating a mean velocity $\omega_{22,n-1}$ of the engine over injection cycle 22. The mean velocity $\omega_{22,n-1}$ is calculated over a duration T' which is offset from TDC 33 by the angle of offset α. This angle of offset α permits expectation that the test pulse sent to the selected injector, which occurs in the vicinity of top dead centre 33, has had its effect, i.e. causing an effective injection of fuel in the injection cycle 22, where necessary, and therefore combustion. This angle of offset α is for example of the order of 30°. The test pulse of current duration $D_{n-1}$, which has been generated in the vicinity of TDC 33, is shown by way of illustration on the first line of FIG. 3. FIG. 3 shows, on three consecutive passages through loop 43, the shape of the test pulse (left column) and the corresponding effective displacement of the needle of the injector under test (right column). The signal of displacement of the injector $\mathbf{45}_{n-1}$ shows that the injector has not opened. This absence of injection is also visible in FIG. 2. The instantaneous engine velocity over injection cycle 22, represented by the arch $\mathbf{22}_{n-1}$ being identical to arch 21, that is to say that $\omega_{22,n-1}=\omega_{21,n-1}$.

When the mean velocity $\omega_{22,n-1}$ has been calculated, the process passes to step 103, which consists of calculating the mean velocity difference $$\Delta\Omega_{n-1}=\omega_{22,n-1}-\omega_{21,n-1}.$$

It will be noted that calculation of the mean velocity difference over two consecutive injection cycles 21, 22 allows limitation of the influence of external parameters on the mean velocity difference. In particular, the variation in mean velocity due to natural slowing of the engine is negligible over such a short duration. The pair $(\Delta\Omega_{n-1},D_{n-1})$ is stored. Step 103 can also be performed outside loop 43.

In step 104, a pulse duration $D_n$ greater than the duration $D_{n-1}$ is selected. The pulse of duration $D_n$ is shown by way of illustration on the second line of FIG. 3.

In step 105, the duration $D_n$ is compared with a preselected maximum pulse duration $D_{max}$. If the duration $D_n$ is less than the maximum duration, the process returns to step 100 for another passage through loop 43, otherwise passage is made to step 106. In the present case, it is considered that the duration $D_n$ is less than the duration $D_{max}$.

At the next passage through loop 43, the mean velocities $\omega_{21,n}$ and $\omega_{22,n}$ are calculated in similar manner. FIG. 3 shows the signal of displacement $\mathbf{45}_n$ of the selected injector in response to the pulse of duration $D_n$. The signal $\mathbf{45}_n$ shows that the injector opened for an opening duration $\tau_n$. An effective injection of fuel therefore occurs in the injection cycle 22, the result of which can also be seen in FIG. 2; the mean velocity $\omega_{22,n}$ corresponding to the arch $\mathbf{22}_n$ is greater than the mean velocity $\omega_{21,n}$ corresponding to the arch 21. It will be noted that the arch $\mathbf{23}_n$ is higher than the arch $\mathbf{23}_{n-1}$, although no injection has taken place during the injection cycle $\mathbf{23}_n$. This acceleration of the engine during cycle 23 is due to the inertia of the engine. The mean velocity difference $\Delta\Omega_n$ is calculated and the pair ($\Delta\Omega_n$, $D_n$) stored. In step 104, a pulse duration $D_{n+1}$ greater than the duration Dn is selected. The duration $D_{n+1}$ is represented on the third line of FIG. 3. The duration $D_{n+1}$ being smaller than the duration $D_{max}$, the process returns to step 100.

At the next passage through loop 43, the mean velocities $\omega_{21,n+1}$ and $\omega_{22,n+1}$ are calculated in a similar manner. FIG. 3 shows the response signal $\mathbf{45}_{n+1}$ of the selected injector to the pulse of duration $D_{n+1}$. The signal $\mathbf{45}_{n+1}$ shows that the injector opened for a greater duration of opening $\tau_{n+1}$ greater than the duration of opening $\tau_n$, which can also be seen in FIG. 2, the mean velocity $\omega_{22,n+1}$ of cycle $\mathbf{22}_{n+1}$ being greater than the mean velocity $\omega_{22,n}$ of cycle $\mathbf{22}_n$. The mean velocity difference $\Delta\Omega_{n+1}$ is calculated and the pair ($\Delta\Omega_{n+1}$, $D_{n+1}$) stored.

Loop 43 is repeated in similar manner until the pulse duration reaches the maximum duration $D_{max}$ or the stability condition is no longer verified. When the process quits loop 43, it passes to step 106.

In step 106, the stored mean velocity differences $\Delta\Omega_{n-1}$, $\Delta\Omega_n$, $\Delta\Omega_{n+1}$ are filtered by convolution with a lowpass filter W, so as to smooth differences due to noise, in particular to measurement uncertainties. The filter W is for example a sliding mean centred using values preceding and values following the value to be verified, for example with weighting in the form of a sinusoidal or Gaussian arc.

$$\Delta\Omega f=\Delta\Omega(D)*W=\int\Delta\Omega(D-D').W(D')dD'.$$

Figure 6:
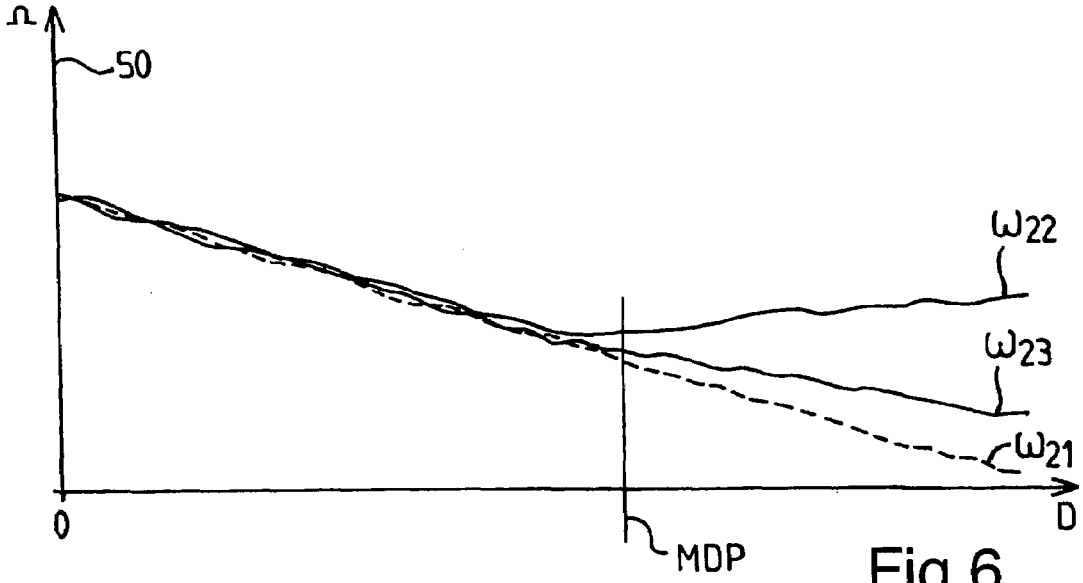
FIG. 6 is a graph showing a series of curves showing the evolution of the mean velocity of the engine each time over the injection cycles of a particular injector, as a function of time.

In practice, the convolution is calculated discretely. For the sake of clarity, FIG. 6 shows the evolution of the mean velocities $\omega_{21}$, $\omega_{22}$, $\omega_{23}$ as a function of the test pulse duration D. When the drive pulse D is smaller than the minimum drive pulse MDP, the mean velocities $\omega_{21}$, $\omega_{22}$, $\omega_{23}$ decrease in similar manner. It will be noted that, when the injectors 7 inject no flow during a plurality of engine cycles, which is for example the case of operation with the foot lifted, the crankshaft nevertheless continues to turn due to inertia. The mean engine velocity, the mean being for example taken over each engine cycle, is at this moment decreasing, this decrease being relatively slow. When the drive pulse D is greater than the MDP duration, the mean velocity $\omega_{21}$ continues to decrease in the same manner, while the mean velocity $\omega_{22}$ starts to increase. At this moment, the curve of the mean velocity $\omega_{23}$ bends because the acceleration undergone by the crankshaft at injection cycle 22 is still perceptible at injection cycle 23, due to inertia.

Figure 7:
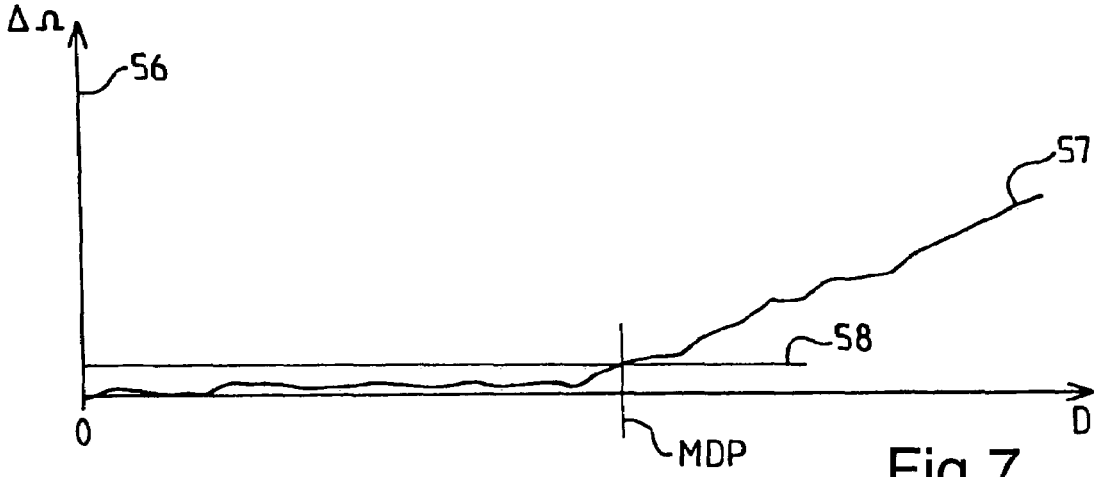
FIG. 7 is a graph showing a curve showing the evolution of the difference between two curves of FIG. 6.

FIG. 7 shows a curve 57 representing the filtered mean velocity difference $\Delta\Omega$f, axis 34, between the curve of the mean velocity $\omega_{22}$ and the curve of the mean velocity $\omega_{21}$ of FIG. 6. The curve 57 is close to zero while the duration D of the drive pulses emitted to the injector to be tested does not cause an injection, that is to say that the duration D is smaller than MDP.

Step 107 consists of determining the drive pulse MDP from which it is considered that an injection has actually occurred. For this purpose, the values of the curve 57 are compared with a predetermined threshold 58. The threshold 58 is so selected that it is located above the noise.

It will be noted that the minimum drive pulse $MDP_0$ is initially known for each injector 7, subject to a tolerance range, for this is a specification of the new injector. The existence of a small error in the initial value is not a problem, as the process finally permits its correction. The minimum drive pulse MDP changes when the injector 7 ages. To find the minimum drive pulse MDP, one solution therefore consists of scanning the curve 57 in the direction of increasing drive pulse durations D over an interval centred on the known preceding minimum drive pulse $MDP_0$. For example, the scanned interval may extend from 100 μs to some hundreds of μs. $D_0$ and $D_{max}$ are for example set such that $D_0=MDP_0-50$ μs and $D_{max}=MDP_0+50$ μs, the minimum drive pulse $MDP_0$ being of the order of 100 μs. Another solution consists of scanning this interval by dichotomy.

In step 108, the value of MDP is stored. When the value of MDP has been stored, the process may return to step 98, if the minimum drive pulse of another injector is to be determined, to step 97 if the minimum drive pulse of an injector is to be determined for a different rail pressure, or to step 96 if the learning process is terminated. In this case, the process awaits an initialisation signal to re-start.

Determination of a Stable Zone

FIG. 5 shows the steps of a routine which runs for example continuously, in parallel with the process described with reference to FIG. 4. This routine permits testing of the stability condition, which is verified when the vehicle is in a so-called stable zone, i.e. a zone in which the mean velocity of the engine is substantially constant.

In step 80, the first test, Test 1, consists of verifying that the accelerator pedal is completely released.

In step 81, the second test, Test 2, consists of verifying that the engine velocity is within an acceptable range. This range is for example between 750 and 3000 rpm. Outside this, a test pulse creates very little variation in the engine velocity ω, even if there is actually an injection, due to the inertia of the engine. Moreover, the crankshaft sensor 12 having a measurement period of the order of the microsecond, increasing the crankshaft velocity increases the margin of error.

In step 82, the third test, Test 3, consists of verifying that the gear-box is in the correct range. This corresponds for example to a gear ratio between third and fifth. In fact, in first or second, acceleration or braking causes abrupt variations in engine velocity and this causes problems in measurement accuracy. This test comes down more or less to verifying that the speed of the vehicle is greater than 30 km/h, which condition could also be the subject of a test.

In step 83, the fourth test, Test 4, consists of verifying that clutch engagement is activated, i.e. that the engine is coupled to the wheels. At 2500 rpm, when the user declutches, the velocity drops very quickly, which poses correction problems, as will be described later in detail.

In step 84, the fifth test, Test 5, consists of verifying that the temperatures of the water, fuel, air and oil are within an acceptable range. At very low temperature, combustion is unstable. When the engine is hot, friction is minimised. This test therefore serves to anticipate that the engine will be in steady state.

To these tests can be added other tests intended to verify the correct operation of the equipment required by the process.

Here, in step 85, the sixth test, Test 6, consists of verifying that the voltage at the battery terminals is correct.

In step 86, the seventh test, Test 7, consists of verifying that no sensor 12 essential to the proper operation of the process is malfunctioning.

The stability condition is verified when all the tests are verified. For example, a logic variable S may be used. In this case, the stability variable S is set to 1 in step 79. If one of the above-mentioned tests produces a negative result, the variable S is set to 0 in step 78. The value of this variable is used in step 100 to determine whether loop 43 must be performed.

Stopping the Process

The value of the minimum drive pulse MDP depends on the pressure of the common rail 6. This MDP value varies when the pressure of the common rail 6 varies. It is therefore desirable to perform the learning process for pressures of rail 6 covering the widest possible pressure range. The stability condition defined in FIG. 5 will typically be verified when the accelerator pedal is released after a phase of acceleration and the vehicle is continuing its travel under its momentum without requiring torque from the engine. Under these conditions, a rail pressure may therefore be selected at which it is desired to perform the process, and this pressure maintained in the rail 6 instead of allowing it to drop as would occur in normal operation of the vehicle. When a user again presses on the accelerator pedal during the progress of the learning process, the drive computer 8 reacts by interrupting learning and producing the signals for control of the injectors necessary to inject fuel in accordance with the demand signal produced by the pedal, in accordance with an algorithm which is itself known. However, the pressure which has been maintained in the common rail during learning is not necessarily suited to the quantity of fuel which must be injected, i.e. which can be burnt. This could cause combustion noise if this pressure is too high. Several means can be provided to eliminate or at least reduce the combustion noise generated by an unsuitable rail pressure during the transition between the learning process and a phase of re-acceleration of the vehicle.

For this purpose, a high pressure valve 10 is opened to lower the pressure in the common rail 6 when this is to be decreased. The high pressure valve 10 permits very rapid reduction of the pressure in the rail 6. For example, a high pressure valve permits a reduction of the order of 2000 bars/s. The use of a high pressure valve 10 therefore permits very rapid reduction of the rail pressure after learning at high pressure.

In addition, it is advantageous for the drive computer 8 to control the injectors with at least one pilot pulse before the main pulse, so as to produce an additional pilot injection very close to the main injection, which also permits reduction of combustion noise. The additional pilot injection is so positioned as to reduce the noise to the maximum extent, for example as close as possible to the main injection.

As indicated, the process described above functions correctly over a wide operating range of the engine, for example from idling to 3000 rpm. As a velocity averaged over an injection cycle is used to determine the MDP parameter, the process is not sensitive to the precise shape of the arch corresponding to each injection cycle. Even at high revolutions, when the arches start to be deformed by inertia of the engine, the process always produces reliable results.

The learning process, described above in the case of operation with the foot raised, can also be performed during operation in a stabilised state, when the accelerator pedal is pressed in a substantially constant manner, and the fuel flows calculated by the drive computer 8 are therefore stable and identical for all the injectors. In this modified embodiment, Test 1 is replaced by a Test 1' which tends to test whether these conditions are verified. The process is otherwise identical. In this case, all the injectors receive control signals from the drive computer 8, for example in the form of a main pulse preceded by one of more pilot injections. These pulses are fixed relative to the top dead centres of the pistons in accordance with a known technique. The injector under test in addition receives the test pulse or pulses, which can for example be positioned in advance of the main pulse or, where necessary, the pilot pulse.

The necessity of providing for the supplies to all the injectors can impose limits on the range within which the rail pressure can be fixed during learning. In fact, it is necessary to prevent excessive combustion noise. For this purpose, it is preferable to perform injection into the cylinders in the form of multiple pulses. The presence of one or more pilot injections prepares and heats the mixture of diesel oil and air and tends to reduce noise by lengthening the duration of combustion.

Figure 11:
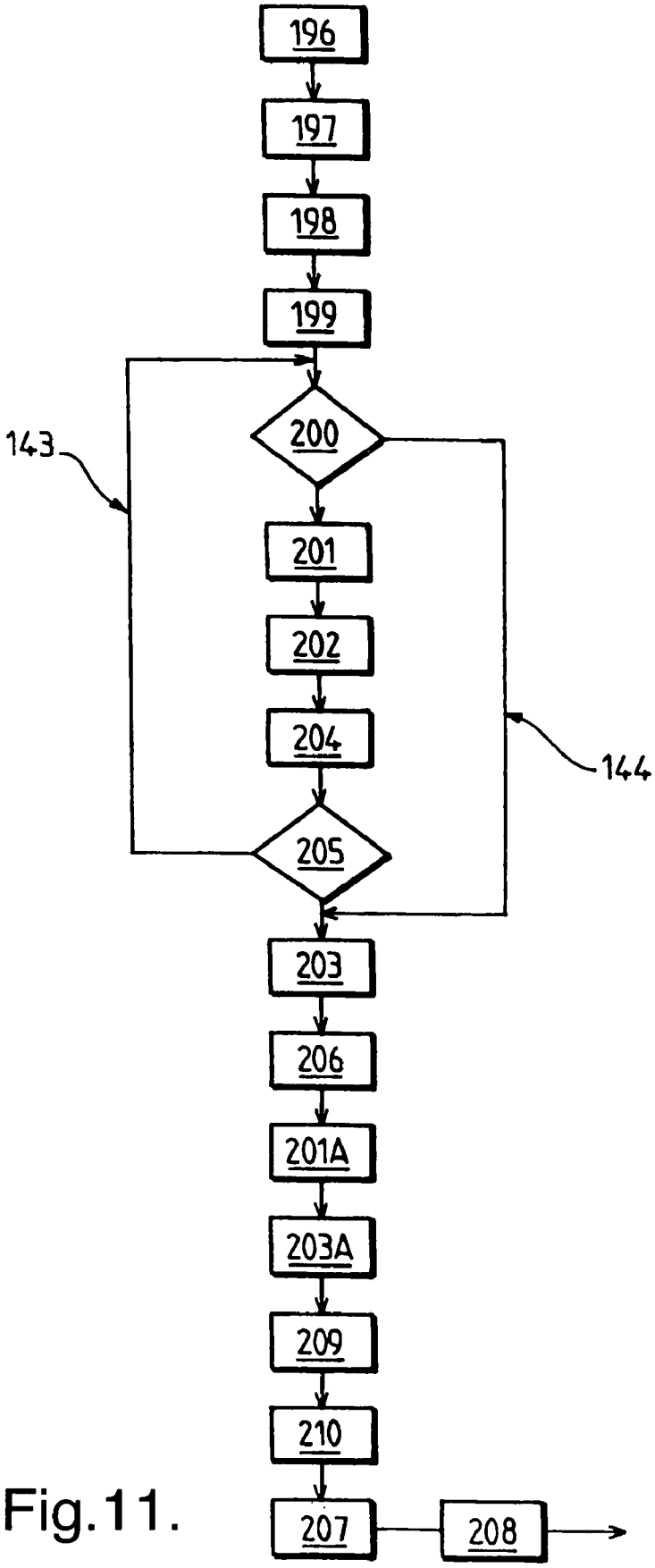
FIG. 11 is a block diagram showing the steps of the learning process, in accordance with the second embodiment of the invention.

A second embodiment will now be described in which the process can be performed in a so-called unstable zone, i.e. in which, in addition to the fact that the cylinders are allowed to be supplied with fuel, the engine velocity is allowed to vary relatively rapidly. Correction calculations permit compensation for the variations in engine velocity due to the influence of parameters external to the learning process, such as acceleration or braking. With reference here to FIG. 11, the steps of the learning process will now be described. The steps similar to the first embodiment are designated by the same reference numbers increased by 100. The steps identical to the first embodiment will not be described again.

In this embodiment, the stability condition to be tested can be rendered much less restrictive (step 200). Of course, steps 81 to 86 of FIG. 5 can be retained. An additional condition consisting of verifying that the engine is within an acceptable load range can be added.

The description of two passages through loop 143 will be sufficient to understand its principle.

Step 201 consists of storing the instantaneous engine velocity $\omega$ over a duration T essentially covering injection cycle 21, which immediately precedes cycle 22. The duration of acquisition T is identical to the first embodiment. This batch of measurements is called $v_{21,n}$.

Step 202 consists of storing the instantaneous engine velocity $\omega$ over a duration T1 essentially covering injection cycle 22. This batch of measurements is called $v_{22,n}$. The set $(v_{21,n}, v_{22,n}, D_n)$ is stored.

Step 204 is identical to step 104.

Step 205 is identical to step 105. In the present case, it is considered that the duration $D_{n+1}$ is less than the duration $D_{max}$.

At the next passage through loop 143, the velocities $v_{21,n+1}$ and $v_{22,n+1}$ are stored in similar manner. The set $(v_{21,n+1}, v_{22,n+1}, D_{n+1})$ is stored.

In this embodiment, loop 143 only includes steps of acquisition of the instantaneous engine velocities over injection cycles 21 and 22. When the process quits loop 143, it passes to step 203.

In step 203, the mean engine velocity $\omega_{21,n}$, over injection cycle 21 is calculated from the instantaneous velocity $v_{21,n}$, in a manner which has been described in detail in the first embodiment, and the mean engine velocity $\omega_{22,n}$ over injection cycle 22 is calculated from the instantaneous velocity $v_{22,n}$. The mean velocity difference $\Delta\Omega_n=\omega_{22,n}-\omega_{21,n}$ is calculated. The pair $(\Delta\Omega_n, D_n)$ is stored. In a similar manner, the mean engine velocity $\omega_{21,n+1}$ over injection cycle 21 is calculated from the instantaneous velocity $v_{21,n+1}$, the mean engine velocity $\omega_{22,n+1}$ over injection cycle 22 is calculated from the instantaneous velocity $v_{22,n+1}$, and then the mean velocity difference $\Delta\Omega_{n+1}=\omega_{22,n+1}-\omega_{21,n+1}$ is calculated. The pair $(\Delta\Omega_{n+1}, D_{n+1})$ is stored.

In step 201A, the mean velocity $\omega_{21,n}$ is compared with the mean velocity $\omega_{21,n-1}$ and an offset $\kappa_n$ is calculated from the difference $\omega_{21,n}-\omega_{21,n-1}$. In the same manner, an offset $\kappa_{n+1}$ is calculated from the difference $\omega_{21,n+1}-\omega_{21,n}$.

In step 203A, the offset $\kappa_n$ ($\kappa_{n+1}$ respectively) is used to calculate a correctional factor $f(\kappa_n)$ ($f(\kappa_{n+1})$ respectively)

which is subtracted from the velocity difference $\Delta\Omega_n$ ($\Delta\Omega_{n+1}$ respectively), so as to store a corrected mean velocity difference $\Delta\Omega c=\Delta\Omega_n-f(\kappa_n)$ ($\Delta\Omega c_{n+1}=\Delta\Omega_{n+1}-f(\kappa_{+1})$ (respectively). This correctional factor compensates for the engine velocity variations due to braking and acceleration.

In step 206, the stored corrected mean velocity differences $\Delta\Omega c_n$, $\Delta\Omega c_{n+1}$ are filtered by convolution with the lowpass filter W.

Figure 8:
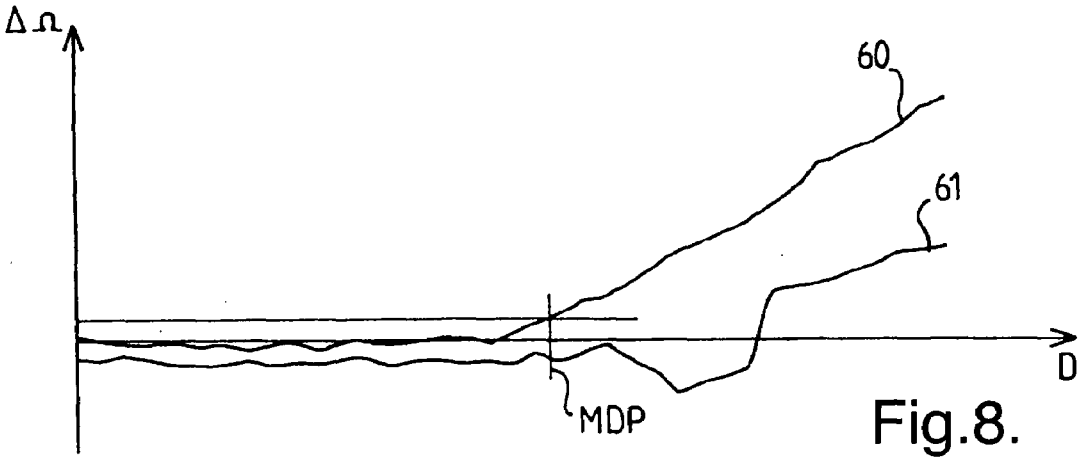
FIG. 8 is a graph similar to FIG. 7 showing the results of the learning process in accordance with a second embodiment of the invention.

An example of the result obtained with this process is shown in FIG. 8, for which braking has been performed during acquisition of the mean velocities.

The curves 60 and 61 shown in FIG. 8 show the evolution as a function of the duration D of the mean velocity difference $\Delta\Omega$, curve 61, and of the corrected mean velocity difference $\Delta\Omega c$, curve 60. When curve 61 drops, for example due to braking, this abrupt modification to the engine velocity is measured by the offset $\kappa$ and compensated for by the correctional factor $f(\kappa)$, so that it does not influence the evolution of curve 60 and in particular its intersection with the threshold 58.

When the engine ages, the compression rates of the different cylinders can be modified, which causes different engine velocities over the different injection cycles. This results in unbalancing of the engine. The object of step 209 is to measure the influence of this type of imbalance on the mean velocities $\omega_{21,n}$ and $\omega_{22,n}$ and to correct the mean velocity difference $\Delta\Omega_n$ to compensate for this influence. For this purpose, the value of the mean velocity difference $\omega_{21,i}-\omega_{22,i}$ is used in the absence of a test pulse. This value can be determined before execution of the learning process or during it, for example in the course of a passage i through loop 143 during which the test pulse is suppressed. A correctional factor is therefore calculated from the mean velocity difference $\omega_{21,i}-\omega_{22,i}$ and applied [to] the mean velocity difference $\Delta\Omega_n$ or $\Delta\Omega c_n$.

In step 210, the mean engine velocity $\Omega_n$ over the engine cycle corresponding to the loop of rank n at which the process is being performed is taken into account. Due to the inertia of the engine, the mean velocity difference $\Delta\Omega_n$ generated by a given test pulse depends on the engine velocity. For example, when 1 mg of fuel is injected at 1000 rpm, the deviation in the mean velocity $\Delta\Omega_n$ generated is greater than that produced by an injection of 1 mg at 3000 rpm. The mean velocity differences $\Delta\Omega_n$ obtained are then adjusted by a scaling factor dependent on $\Omega_n$. This scaling factor is for example calculated prior to the execution of the process and stored in the drive computer 8. For this purpose a curve $\Delta\Omega$ as a function of $\Omega$ can be traced over a wide range of velocities $\Omega$ for a test pulse corresponding to a predetermined injected quantity and the gradient of this curve used as the scaling factor. This adjustment step allows accurate results to be obtained without having to modify the value of the detection threshold 58. Another solution would be to adapt the threshold 58 is similar manner.

Step 207 consists of determining the minimum drive pulse MDP from which it is considered that an injection has actually taken place. For this purpose, the values of the curve 60 are compared with the predetermined threshold 58.

Step 208 is identical to step 108.

Steps 203A, 209 and 210 are correctional steps which are optional. Each of these steps is intended to compensate for a particular phenomenon and can therefore be employed separately from the others or in combination. These correctional steps can also be applied in the first embodiment.

The processes described above can be performed with all types of injector. However, injectors with direct activation allow better accuracy to be obtained, in particular when multiple injections have to be performed.

Figure 9:
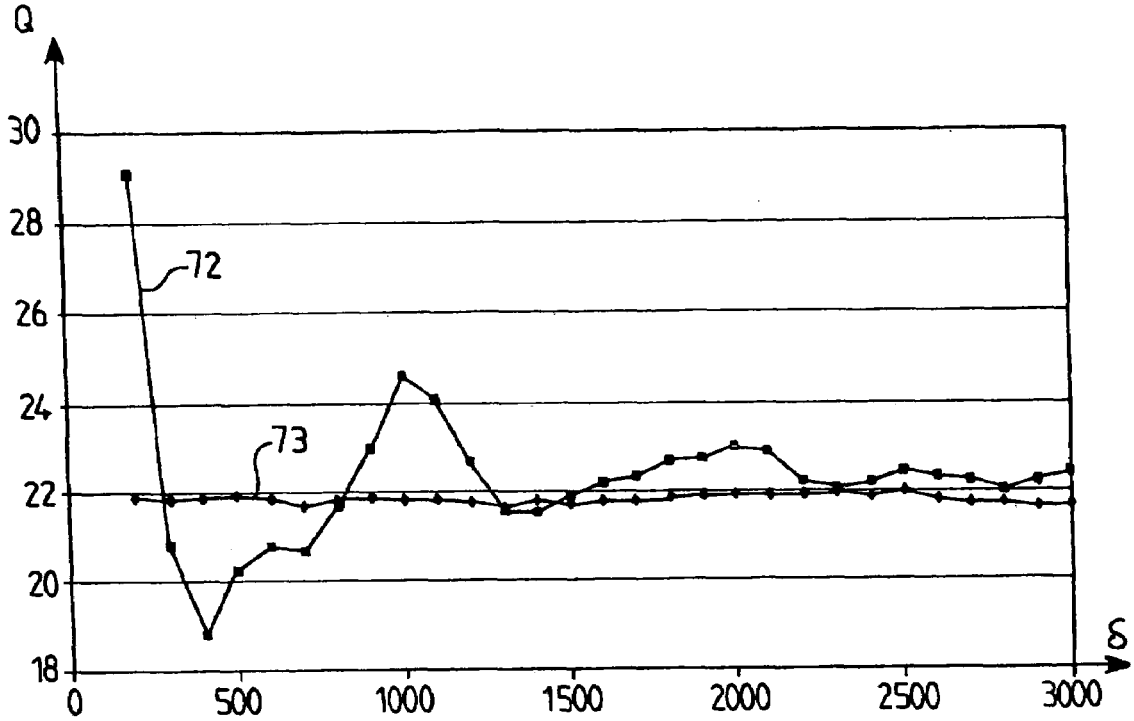
FIG. 9 is a curve showing the quantity of fuel injected at a main injection as a function of the duration of separation between the main injection and a pilot injection, for a piezoelectric injector and a solenoid injector.

FIG. 9 shows the quantity of fuel Q injected in the main injection, axis 70, as a function of the duration of separation $\delta$ between the pilot pulse and the main pulse, axis 71, in the case of a solenoid injector, curve 72, and of a piezoelectric injector, curve 73. The pulses are fixed. Only their separation varies. These two types of injector do not behave in identical manner, this difference being able to modify the results of the learning process significantly.

In the case of use of a solenoid injector, opening is effected in two stages. In a first stage, the valve member is disengaged from the plate, and then in a second stage the needle lifts. Opening of the valve member occurs approximately 150 μs before the opening of the needle. This opening in two stages is explained in particular by the fact that the power generated by the solenoid is not sufficient to lift the needle directly. For certain pilot pulse durations, it may therefore happen that the valve member is disengaged but the needle does not lift. In this case, a flow of fuel is created from the control chamber to the low pressure return. This has the effect of creating pressure waves. In particular, in the case of a multiple injection, the main injection is interfered with by the wave created by the pilot injection and this interference depends on the separation $\delta$. This phenomenon is illustrated in FIG. 9. In this case, even if the pilot injection does not lift the needle, it modifies the main injection, which constitutes an hydraulic interaction. Generally, multiple injection is more complicated to perform with a solenoid injector as each pilot injection interferes with those following by creation of a pressure wave.

Figure 10:
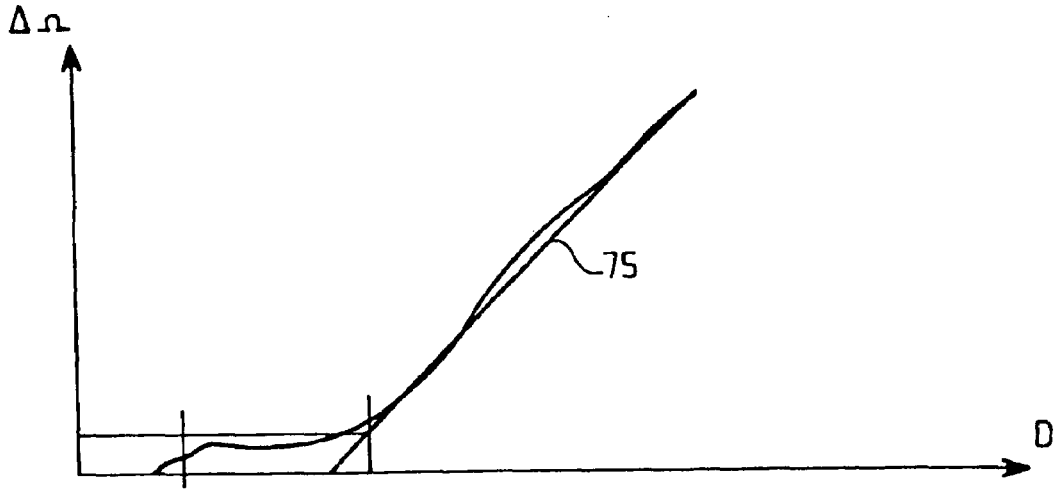
FIG. 10 is a graph showing the evolution of the engine mean velocity difference over injection cycles associated with two injectors for solenoid injectors, as a function of time.

FIG. 10 shows a curve of mean velocity difference $\Delta\Omega$ as a function of time t. A reference curve marked 75 has also been traced. The pressure wave generated by the pilot injection modifies the mean engine velocity 29 over the cycle of the injector to be tested before actual opening of the injector. This results in an increase in the mean velocity difference 34 which can exceed the threshold 58. This therefore risks generation of detection errors of the minimum pulse 43*b*.

This problem does not occur with injectors with direct actuation, such as piezoelectric injectors 73. The learning process described in the present invention is therefore particularly suited to injectors with direct actuation, for example piezoelectric injectors 73, although it can also be implemented with solenoid injectors 72, taking into account the behavioural difference.

Other modifications are also possible. For example, in each embodiment, the control signal can include a plurality of test pulses of the same duration D. For example, a test pulse is so positioned that the crankshaft is situated before TDC and a second test pulse is so positioned that the crankshaft is situated close to TDC. The mean velocity difference $\Delta\Omega$ being proportional to the difference in the quantity of fuel injected by the injectors associated with the two cycles 21, 22, this difference is thus multiplied by the number of pulses, which permits improvement of the detection accuracy by increasing the gradient of the curve in FIG. 7 or 8.

It will be noted that it is also possible to calculate the means velocity over another injection cycle preceding cycle 22, for example cycle 20.

It will be noted that the higher the revolutions, the more frequent are the injections. At 2000 rpm, injection occurs every 60 ms and it takes approximately 2 s to perform learning. When the number of revolutions per minute increases, the learning time decreases.

Certain steps of the learning process can be performed in a different order or simultaneously without changing the result.

In addition, the learning processes described can be immediately adapted to determining any other parameter of the control signal. For this purpose, the test pulse can be modified by a parameter other than its duration, for example gradient, amplitude, or other parameter.

Although the invention has been described in relation to several particular embodiments, it is quite obvious that it is in no way limited to them and that it includes all the technical equivalents of the means described and their combinations if these fall within the scope of the invention.

What is claimed is:

1. A process for determining the operating parameters of an injection device of a combustion engine, said injection device including a plurality of fuel injectors, and an electronic control means able to control said injectors by means of injection control signals, said electronic control means being connected to a sensor permitting continuous measurement of a velocity of said combustion engine, said engine operating in accordance with an engine cycle including at least one injection cycle associated with each of said injectors, said injection cycles following each other in a predetermined order, the process comprising the steps of:

a) selecting an injector to test from said injectors;

b) calculating a mean velocity associated with a preceding injector arranged before said injector to test in the order of said injection cycles, which is equal to the velocity of said engine averaged over a measurement duration essentially covering one injection cycle associated with said preceding injector;

c) for said injection cycle associated with said injector to test, applying to said injector to test an injection control signal including at least one test pulse having an adjustable parameter;

d) calculating a mean velocity associated with said injector to test, which is equal to the velocity of said engine averaged over a measurement duration essentially covering said injection cycle associated with said injector to test;

e) calculating a difference between the mean velocity calculated in step d) and said mean velocity calculated in step b);

f) repeating steps b) to d) for at least another engine cycle, each time varying said parameter of the test pulse;

g) determining a value of said parameter of the test pulse for which said mean velocity difference exceeds a predetermined threshold and storing said parameter value.

2. A process as described in claim 1, wherein said injectors have direct actuation.

3. A process as described in any claim 1, wherein, in said step of applying to said injector, said control signal includes a plurality of test pulses, the value of said parameter for each of said test pulses being substantially equal.

4. A process as described in claim 1, wherein said parameter is a pulse duration.

5. A process as described in claim 1, wherein, while the process is being performed, said injection control signals of the injectors other than said injector to test are substantially nil.

6. A process as described in claim 1, wherein, while the process is being performed, said electronic control means provides to said injectors injection control signals including a main pulse corresponding to a demand from a gas control organ.

7. A process as described in claim 1, wherein, before said step of determining a value, a filtered mean velocity difference is calculated by applying a convolution by a filter to the curve representing the mean velocity difference as a function of said test pulse parameter, and said filtered mean velocity difference is used in said step of determining a value.

8. A process as described in claim 7, wherein said filter is a sliding mean.

9. A process as described in claim 1, further comprising the steps of testing a predetermined stability condition to detect stable operation of said engine and terminating said process when said stability condition is not satisfied.

10. A process as described in claim 9, wherein said stability condition includes an engine velocity condition, which condition is verified when said engine velocity is between two predetermined thresholds.

11. A process as described in claim 9, wherein said stability condition includes an engine torque condition, which condition is verified when the engine torque is between two predetermined thresholds.

12. A process as described in any claim 9, wherein said stability condition includes a gear ratio condition, which condition is verified when said gear ratio is higher than a predetermined threshold.

13. A process as described in claim 9, wherein said stability condition includes a vehicle speed condition, which condition is verified when said vehicle speed is greater than a predetermined threshold.

14. A process as described in claim 9, wherein said stability condition includes a clutch engagement condition, which condition is verified when clutch engagement is activated.

15. A process as described in claim 1, further comprising, for each engine cycle, a step of calculating a difference between said mean velocity calculated in said step of calculating a mean velocity for said engine cycle and said mean velocity calculated in said step of calculating a mean velocity for a preceding engine cycle, and a step of calculating a corrected mean velocity difference by correcting said mean velocity difference calculated in said step of calculating a difference.

16. A process as described in claim 1, wherein said velocity of said combustion engine corresponds to the rotational velocity of a crankshaft of said combustion engine, said measurement duration associated with an injector extending each time between an initial instant retarded by an offset angle of the crankshaft relative to combustion top dead centre of a piston corresponding to said injector and a final instant retarded by said offset angle relative to top dead centre of the piston corresponding to the next injector in the order of said injection cycles.

17. A process as described in claim 16, wherein the offset angle is less than or equal to 45°.

18. A process as described in claim 1, wherein said injection device includes a common rail provided with a high pressure valve, each of said injectors being connected to said common rail.

19. A process as described in claim 18, further comprising a step of selecting a common rail pressure in a range of from 200 to 2000 bars and a step of performing said process while maintaining said rail pressure in said common rail.

20. A process as described in claim 19, further comprising the steps of detecting actuation of an organ for controlling the gases of said vehicle corresponding to a fuel demand, calculating a target common rail pressure suited to said fuel demand, and, when the target pressure is less than said selected common rail pressure, decreasing the pressure in said common rail by opening said high pressure valve.

21. A process as described in claim 19, further comprising the steps of detecting actuation of an organ for controlling the gases of said vehicle corresponding to a fuel demand, calculating a target common rail pressure suited to said fuel demand, and, when the target pressure is less than said selected common rail pressure, providing injection control signals to said injectors including at least one pre-injection pulse and a main pulse.

* * * * *